US006367323B1

(12) United States Patent
Camwell et al.

(10) Patent No.: US 6,367,323 B1
(45) Date of Patent: Apr. 9, 2002

(54) DYNAMIC PRESSURE DEVICE FOR OIL DRILL SYSTEMS

(75) Inventors: Paul L. Camwell; Michael T. Sutherland; Anthony Robert Dopf; Derek W. Logan; Randall S. Liscombe, all of Calgary (CA)

(73) Assignee: Ryan Energy Technologies, Inc., Calgary (CA)

( * ) Notice: Subject to any disclaimer, the term of this patent is extended or adjusted under 35 U.S.C. 154(b) by 0 days.

(21) Appl. No.: 09/641,092

(22) Filed: Aug. 17, 2000

(51) Int. Cl.[7] ..... E21B 47/00; E21B 47/12
(52) U.S. Cl. ..... 73/152.52; 73/152.03
(58) Field of Search ..... 73/152.48, 152.02, 73/152.03, 152.22, 152.51, 152.52; 166/297; 285/18

(56) References Cited

U.S. PATENT DOCUMENTS

| | | | | |
|---|---|---|---|---|
| 4,297,880 A | | 11/1981 | Berger | 73/155 |
| 4,805,449 A | | 2/1989 | Das | 73/151 |
| 4,919,454 A | * | 4/1990 | Caulfield et al. | 285/18 |
| 6,220,355 B1 | * | 4/2001 | French | 166/297 |

FOREIGN PATENT DOCUMENTS

| | | |
|---|---|---|
| CA | 607352 | 10/1960 |

* cited by examiner

*Primary Examiner*—Hezron Williams
*Assistant Examiner*—Jay L. Politzer
(74) *Attorney, Agent, or Firm*—Lee, Mann, Smith, McWilliams Sweeney & Ohlson

(57) ABSTRACT

A drill string section for use in making up a drill string for oil and gas drilling carries instrumentation for measurement and logging while drilling. The instrumentation includes a dynamic pressure device for measuring drill string bore pressure of incoming pressurized fluid and drill string annular pressure of returned pressurized fluid. The drill string section comprises a length of drill string pipe having a bore defined by an inner surface of a wall which has an outer surface. The instrumentation is provided in an elongate cylindrical tool shell. The outer surface of the tool shell has spaced apart seals which engage the inside surface of a cylindrical landing sleeve in the pipe bore. The seals are located in the sleeve on either side of communicating port(s) in the drill pipe wall, forming a leak tight annular region that eventually communicates through appropriate ports to a pressure transducer.

13 Claims, 7 Drawing Sheets

DYNAMIC PRESSURE DEVICE FOR OIL DRILL SYSTEMS

FIELD OF THE INVENTION

Petroleum exploration activities occasionally require specialized drilling techniques to optimise production from certain types of reservoir stratum. One such drilling technique is known as "underbalanced" drilling, which employs singly or a combination of nitrogen, carbon dioxide or other inert gasses, and drilling mud as the primary composite drilling fluid. In this situation, down hole pressure of the composite drilling fluid is monitored within the drill string bore and the well annulus, with the goal of preventing formation fracture due to overly high gas pressures. Another goal of underbalanced drilling is to minimise loss of the composite drilling fluid to the formation, which can be re-circulated until drilling is complete. Clearly, a specialized drilling device is needed to measure the drill string and well bore pressures to make underbalanced drilling possible.

BACKGROUND OF THE INVENTION

Although there are a variety of devices for measuring downhole drilling fluid pressure, some of the devices require a temporary cessation of drilling operations, which in some cases incur cost and time delays unacceptable to drilling operators in the competitive exploration market. Such a system is described in Canadian Patent 607,352. Other types of systems allow downhole pressure measurement while drilling, generally making use of electronic pressure measurement tools rigidly fixed to the lower portion of the drill string, near the drill bit. While satisfactory for this service, such devices are irrecoverable in the event that this section of the drill string becomes stuck downhole, and consequently abandoned if efforts to free it are unsuccessful. Typically the drill string above the stuck section is disconnected in some fashion and brought to the surface, leaving behind the drill motor, drill bit, pressure measurement tools and the lower section of the drill string. Examples of such systems are described in U.S. Pat. Nos. 4,297,880 and 4,805,449, which are capable of sensing drill bore and annulus pressure, but as mentioned are irrecoverable in the event of drill string abandonment due to their mechanical design.

There is a significant need for an electronic downhole system that measures pressure in the drill string bore and the well annulus (the area between the collar OD and the well bore), that is retrievable and re-seatable, and reports pressure measurements to the surface in a timely fashion. Such a system permits drillers to make real-time decisions on how to proceed with the drilling operation based upon this and other information. The value of such a device is greatly enhanced by providing retrieval and reseating capabilities. Retrieval permits the recovery of the device in situations where the drill string becomes stuck and must be abandoned. However, certain situations arise where the tool must be recovered temporarily and then returned to the end of the drill string so that the drilling job may be continued. This is known as re-seating, and offers a level of operational flexibility not observed in the general market for similar devices.

SUMMARY OF THE INVENTION

The Dynamic Pressure Device (DPD), in accordance with an aspect of this invention measures pressure in the drill string bore and the well annulus (the area between the collar OD and the well bore) and reports the measurement to a transmitter located within the tool string. The transmitter communicates this information to the surface, where drillers make decisions on how to proceed with the drilling operation based upon this and other information.

In accordance with another aspect of the invention a drill string section for use in making up a drill string for oil and gas drilling is provided. The drill section carries instrumentation for Measurement While Drilling and Logging While Drilling operations, said instrumentation including a Dynamic Pressure Device for measuring drill string bore pressure of incoming pressurized drilling fluid, and drill string annular pressure of returned pressurized drilling fluid, said instrumentation being retrievable from said drill string when said drill string section is stuck or otherwise abandoned downhole, or otherwise reseatable into said drill string as required when drill string is deemed operational and fit for continued drilling. The drill string section comprises:

i) a length of drill string pipe having a bore defined by an inner surface of a pipe wall which has an outer surface, ii) a cylindrical landing sleeve and a support for centering said sleeve in said pipe bore, iii) communicating ports extending through said drill pipe wall from said outer pipe surface to said inner surface and through said support to an inside surface of said landing sleeve, iv) said instrumentation being provided in an elongate cylindrical tool shell, spaced apart seals which engage said inside surface of said landing sleeve and the outer surface of said tool shell, means for locating said communicating ports between said spaced-apart seals, v) said instrumentation in said tool shell having a first terminated passageway in said tool shell between said seals which communicates with a pressure sensor within said shell to sense thereby said drill string annular pressure, vi) said instrumentation having a second terminated passageway in said tool shell in communication with said drill string bore and in communication with a pressure sensor within said shell whereby said drill string bore pressure is sensed.

BRIEF DESCRIPTION OF THE DRAWINGS

Preferred embodiments of the invention are described with respect to the drawings wherein.

DETAILED DESCRIPTION OF THE PREFERRED EMBODIMENTS

Figure 1:
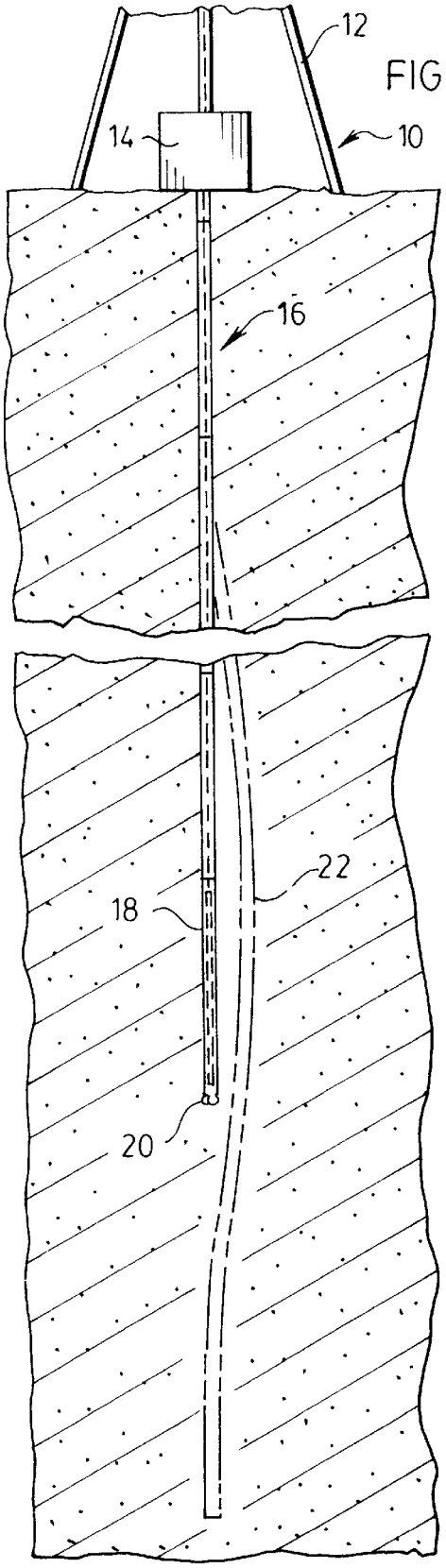
FIG. 1 is a schematic of the abandonment of a downhole drill string.

A representative drilling system is shown in FIG. 1. The above ground drilling structure 10 has the usual tower 12 with drill string assembly and drive components 14. The drill string 16 is made up of individual drill string sections 18, the lower most of which includes a drill bit 20. For a variety of reasons it may be necessary to abandon the downhole drill string particularly the drill string adjacent the drill bit due to the drill bit becoming stuck or otherwise seized in the formation. The abandonment of the lower most drill string can be costly because of the value of the electronic components in the tool sub-assembly which are used to provide for "measurement while drilling and logging while drilling operations". In other cases, the tool itself may fail and requires replacement. In these situations, the replaced tool must be lowered down the drill string and re-seated at its original location so that drilling operations may resume. It is understood of course that when the drill bit 20 is abandoned the operator may commence redrilling of the bore and provide for an alternate route around the abandoned drill section as indicated by the dotted lines 22. A number of contemporary systems provide for retrieval or re-seating of the electronics in circumstances of drill string abandonment or tool replacement, however such systems are not intended or otherwise designed for measuring drill string bore pressure and drill string annular pressure.

Figure 2:
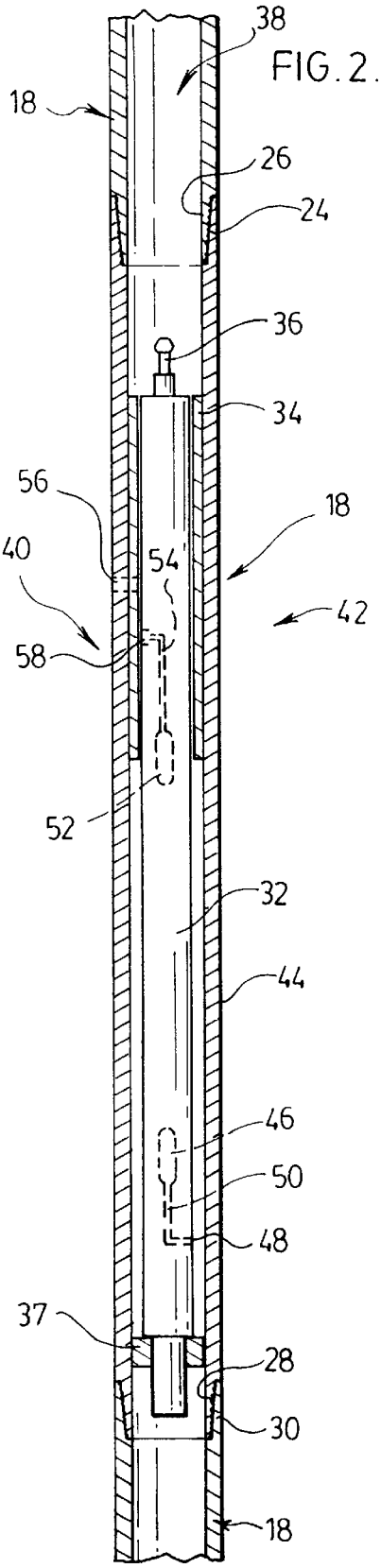
FIG. 2 is a section through the drill string of this invention.

In accordance with this invention, the system shown in FIG. 2 provides for pressure measurements and at the same time allows retrieval and re-seating of the electronic components from, and into, the downhole drill section. The upper female connector 24 of the drill string section is connected to a male threaded connector 26 of an upper drill string section. Correspondingly the male section 28 is threaded into a female section 30 of the lower drill string 18. The electronic components for measurement while drilling and logging while drilling are housed in an elongate cylindrical tool shell 32.

The cylindrical tool shell is positioned within a landing sleeve 34. The cylindrical tool shell may be removed from, or installed into, the landing sleeve in the manner discussed with respect to FIGS. 4 through 7 by grasping a connector stub 36 which is secured to the cylindrical tool shell. A suitable latching mechanism 37 is provided in the drill string to releasably secure the tool shell in the drill string and locate it in the drill string. Although there are a multitude of electrical opponents within the cylindrical tool shell, the specific components of interest in respect to the invention are the devices for measuring drilling fluid pressure in the bore 38 of the tool string and drill string annular pressure in annulus 40. The annulus 40 is defined between the earth formation 42 and the exterior 44 of the drill string section. Pressure transducer 46 is provided to measure the pressure of a circulating drilling fluid in the drill string bore 38. A port 48 in the cylindrical tool shell communicates with a passageway 50, and terminates at the sensor 46. Drill string annular pressure is measured by pressure transducer 52. Pressure sensor 52 is in communication with passageway 54, which in turn communicates through an annular passage formed between the tool barrel and the inside diameter of landing sleeve 34 and ultimately through passageway 56. Passageway 56 communicates with annular space 40, noted as the drill string annular region that conveys returned drilling fluid to the surface.

Figure 3:
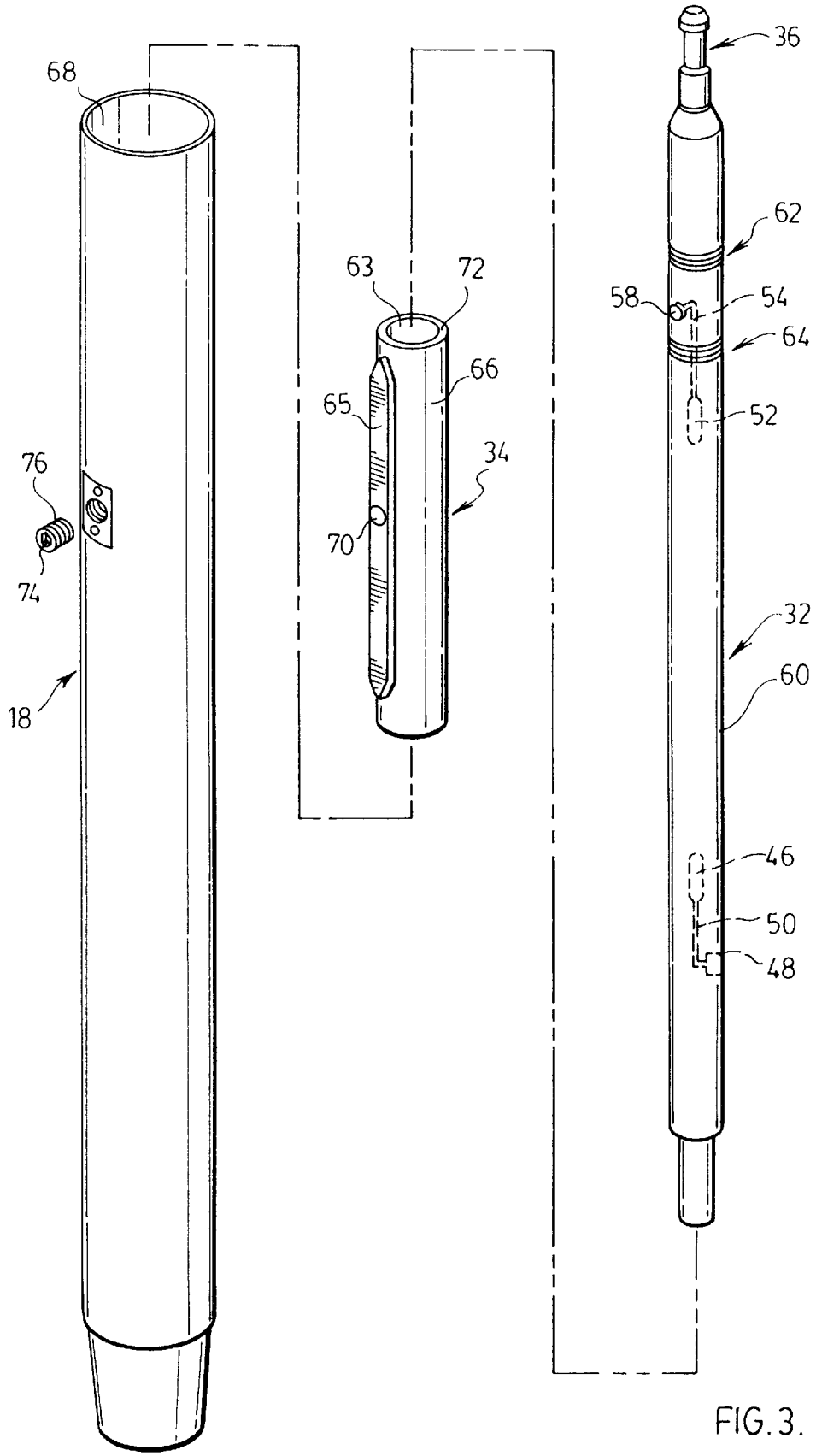
FIG. 3 is an exploded view of the drill section FIG. 2.

Further details of the system are shown in the exploded view of FIG. 3. The elongate cylindrical tool shell 32 has the respective ports 48 and 58 on the periphery 60 of the shell 32. Port 48 is in communication with the pressurized fluid within the bore of the drill string section. Port 58 is located between seals generally designated 62 and 64. The cylindrical tool shell 32 is of a dimension that readily slides through the bore of landing sleeve 34. Seals 62 and 64 project slightly from the periphery 60 of the tool shell and form an interference fit with the interior surface 63 of the landing sleeve, the resulting seal deformation providing a liquid tight seal with the interior of the landing sleeve. Although in accordance with this embodiment, the seals are provided in the tool shell, it is appreciated that the seals may be provided in the interior surface 62 of the landing sleeve to provide a sealed space when the tool shell is inserted into the landing sleeve. The landing sleeve 34 includes supports in the form of legs 65, in accordance with this embodiment, to space the outer periphery 66 of the landing sleeve from the interior surface 68 of the drill string section 18. This allows the drilling fluid to flow through the spaces defined between the periphery of the landing sleeve and the interior of the drill string section. The landing sleeve 34 is secured within the drill string section in accordance with the embodiments to be discussed with respect to FIGS. 4 through 7. In addition the leg 65 includes a port 70 which extends through the leg and the wall section 72 of the landing sleeve. The port 70 is in communication with a port 74 defined within removable plug 76. The landing sleeve is of course fitted to the drill string section before the drill string section is put into use. When the tool shell is inserted in the landing sleeve, a suitable stop, such as the latch 37, is provided to locate the seals 62 and 64 on opposite sides of the port 70 so that the pressurized fluid in the annulus outside of the drill string section may flow through ports 74, 70 and 58 and through passageway 54 to the pressure transducer 52. Seals 62 and 64 also prevent the fluid from the drill string bore, which is at a higher pressure than the annulus fluid, from leaking into the annular space 92 formed between the seals, tool barrel 32 and landing sleeve bore.

Figure 4:
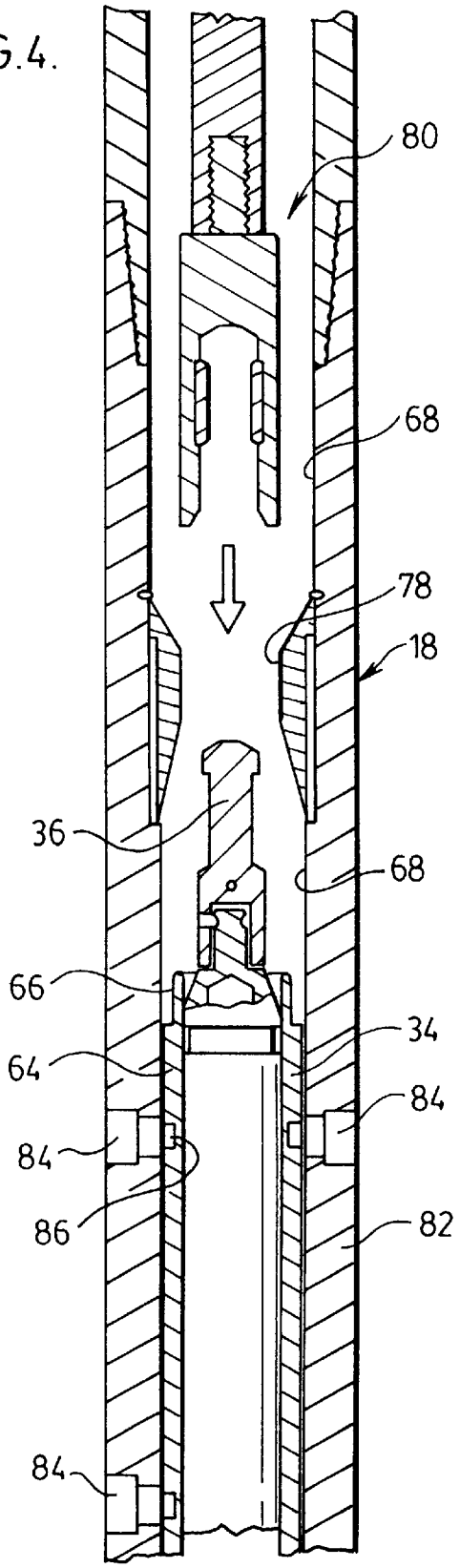
FIGS. 4, 5, 6 and 7 show embodiments of the invention where the pressure sensor system and related electronics can be withdrawn from the drill string when it is necessary to abandon the drill string, or alternately re-seated when required.
Figure 5:
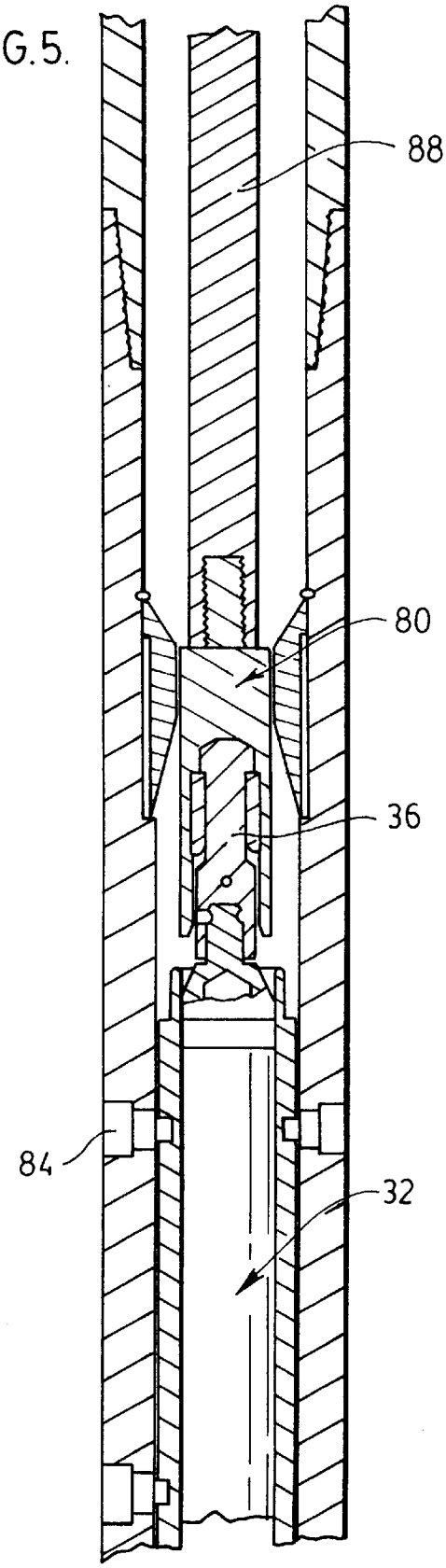
Figure 6:
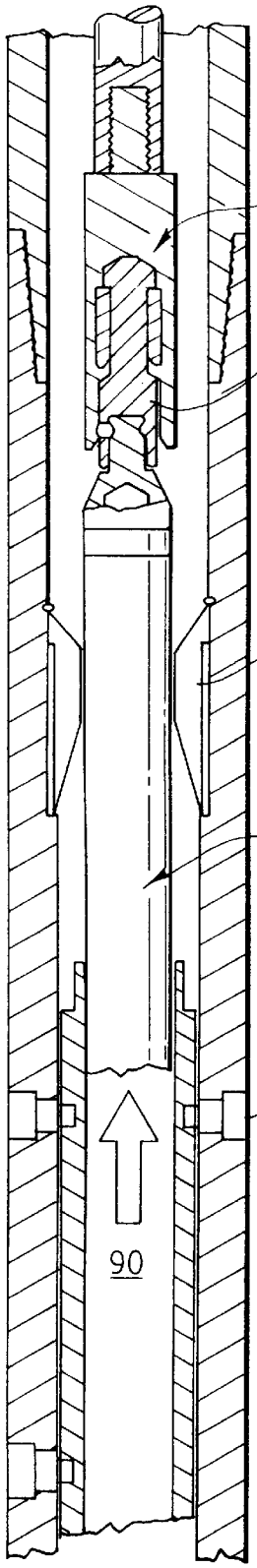

FIGS. 4, 5 and 6 demonstrate the manner in which the cylindrical tool shell may be extracted from the drill string section 18. On the interior surface 68 of the drill string, cams 78 are mounted on drill string interior to guide insertion of the cylindrical tool shell into the landing sleeve 34 during a seating or re-seating operation. The landing sleeve 34 has its leg portions 65 secured in the drill string wall 82 by way of bolts 84 which are threaded into the respective legs 65 in threaded bores 86. The pressurized drilling fluid in the drill string bore flows over the tubular sleeve by way of a space defined between the interior 68 and the exterior 66 of the landing sleeve.

The extraction tool 80 is shown in FIG. 5 as having clamped onto the connector stub 36. Extraction device 80 is connected to a wire line or the like 88. With the extraction device clipped on to the stub 36, the tool shell 32 may be pulled from the landing sleeve in the manner shown in FIG. 6 where the tubular shell is moving in the direction of arrow 90. In this manner, the valuable electronic components in the cylindrical tool shell may be recovered before the drill string and drill bit are abandoned. Similarly, the cylindrical tool shell may be re-installed if the drill string and drill bit are restored to service or the electronics require servicing.

Figure 7:
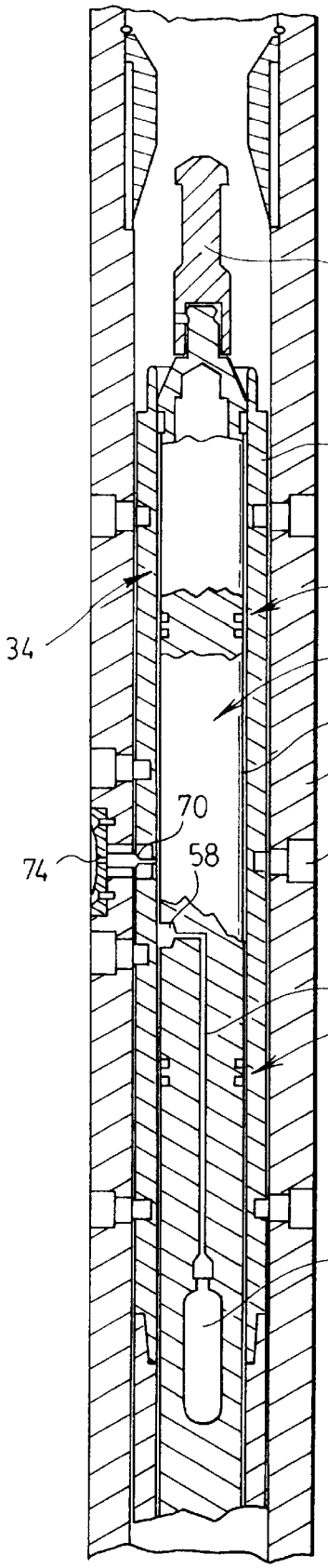

With reference to FIG. 7 the relative relationship of the exterior bore 74 to the interior bore 58 is shown. The exterior bore 74 extends through the wall 82 of the drill string section. The bore 74 communicates with bore 70 which extends through the leg 65 of the landing sleeve 34. The bore opens up into the space defined between the exterior surface 60 of the cylindrical tool shell and the interior surface 63 of the landing sleeve. As previously explained there is a slight gap between the cylindrical tool shell and the interior of the landing sleeve to permit insertion and retraction of the cylindrical tool shell. This space is sealed off to each side of the port 70 by seals 62 and 64. This ensures that all pressurized fluids passing through bores 74 and 70 are contained within the annular space 92. Port 58 is in communication with the annular space 92 so that any pressurized fluid in space 92 enters port 58 and along passage 54 thereby the pressure of such fluid is sensed by the pressure transducer 52. In this manner a reliable economical system is provided which permits measurement of drill string annular pressure while at the same time permitting extraction of the cylindrical tool shell.

Figure 8:
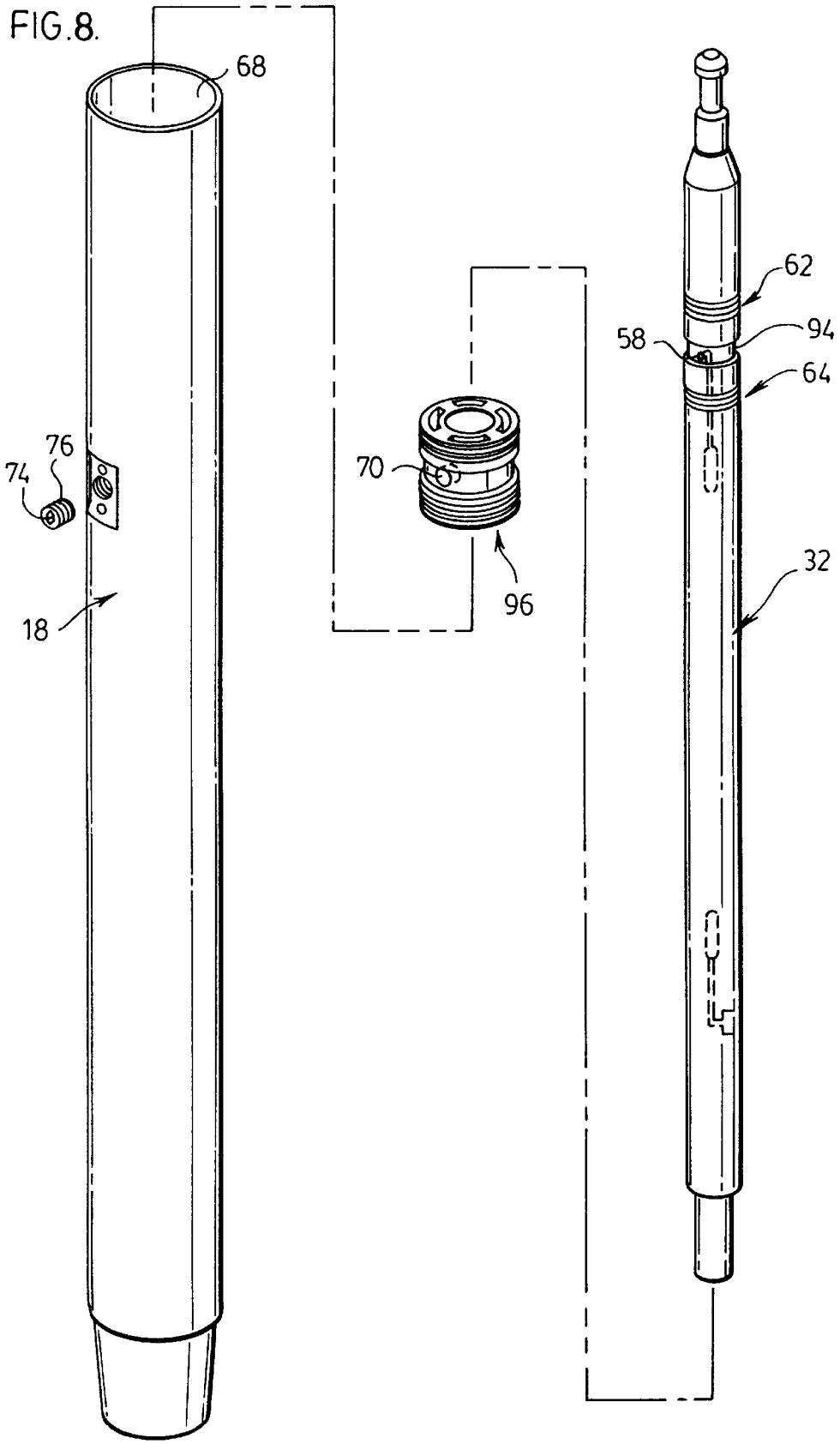
FIG. 8 is an exploded view of an alternative embodiment for the mounting of the pressure measurement system in the drill string.
Figure 9:
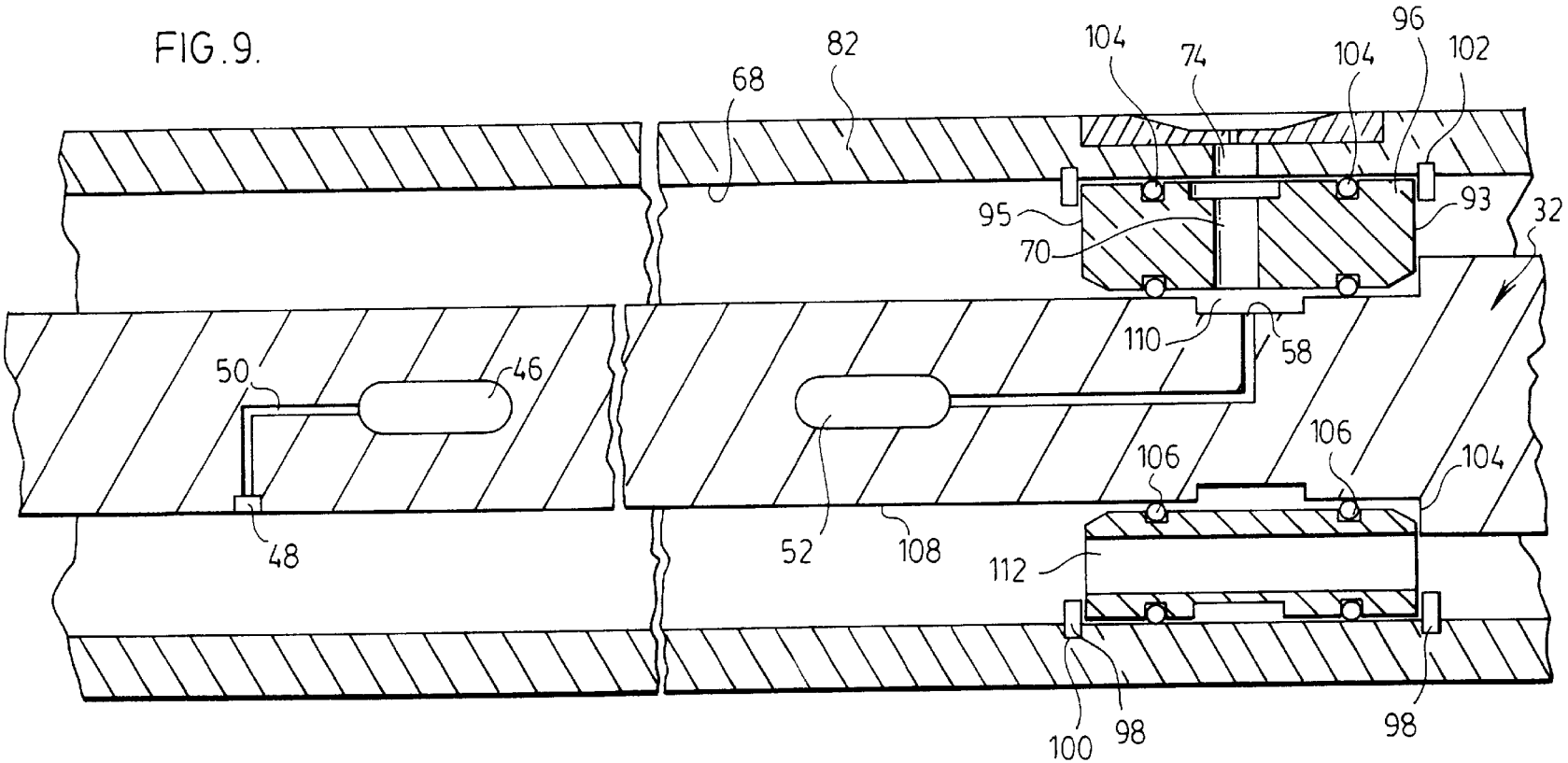
FIG. 9 is a section through the assembly of FIG. 8.

An alternative embodiment for the drill string section is shown in FIG. 8. The construction of the cylindrical tool shell 32 is essentially the same with the spaced apart seals 62 and 64. A slight recess 94 is provided for port 58. The landing sleeve 34 is replaced with an alternative embodiment 96 which is fixed on the interior surface 68 of the drill string section 18 by use of clip rings to be described in more detail with respect to FIG. 9. The port 70 in the landing sleeve 96 is longitudinally aligned with the port 74 of plug 76 which can be achieved during assembly, however radial orientation of port 70 with respect to port 74 is unimportant. With reference to FIG. 9 the landing sleeve 96 is secured inside the tubular string wall 82 by way of C-clips 98 which engage the faces 93 and 95 of landing sleeve 96. The C-clips interconnect with groves 100 and 102 in the drill string section wall. This arrangement permits the installation of the C-clips so that they can bear up against the upstream and downstream faces 93 and 95 of landing sleeve 96.

In accordance with this preferred embodiment the cylindrical tool shell 32 has a ledge 104 which defines a stop and which abuts the upstream face 93 of the landing sleeve. Alternatively, the tool shell 32 may be located by other mechanical stops incorporated on the tool similar to other embodiments of the invention. The landing sleeve includes seals 104 to seal the exterior of the landing sleeve within the interior 68 of the drill string section. In addition to or as a replacement for the preferred embodiment showing seals 62 and 64 on the cylindrical tool shell, the landing sleeve may include seals 106 which seal to the exterior 108 of the cylindrical tool shell to ensure a leak tight connection. The port 74 which extends through the wall of the drill string section is aligned longitudinally, but not necessarily radially, with port 70 and leads into annular space 110. Port 58 leads from pressure transducer 52 and opens into annular space 110, permitting a reading of drilling fluid annular pressure to be made. Multiple arcuate apertures 112 provide open channels for the flow of drilling fluid along the drill string bore. In a manner discussed with respect to FIG. 2, pressure transducer 46 communicates with port 48 through passageway 50 permitting a pressure measurement of the drill string bore fluid to be made.

Figure 10:
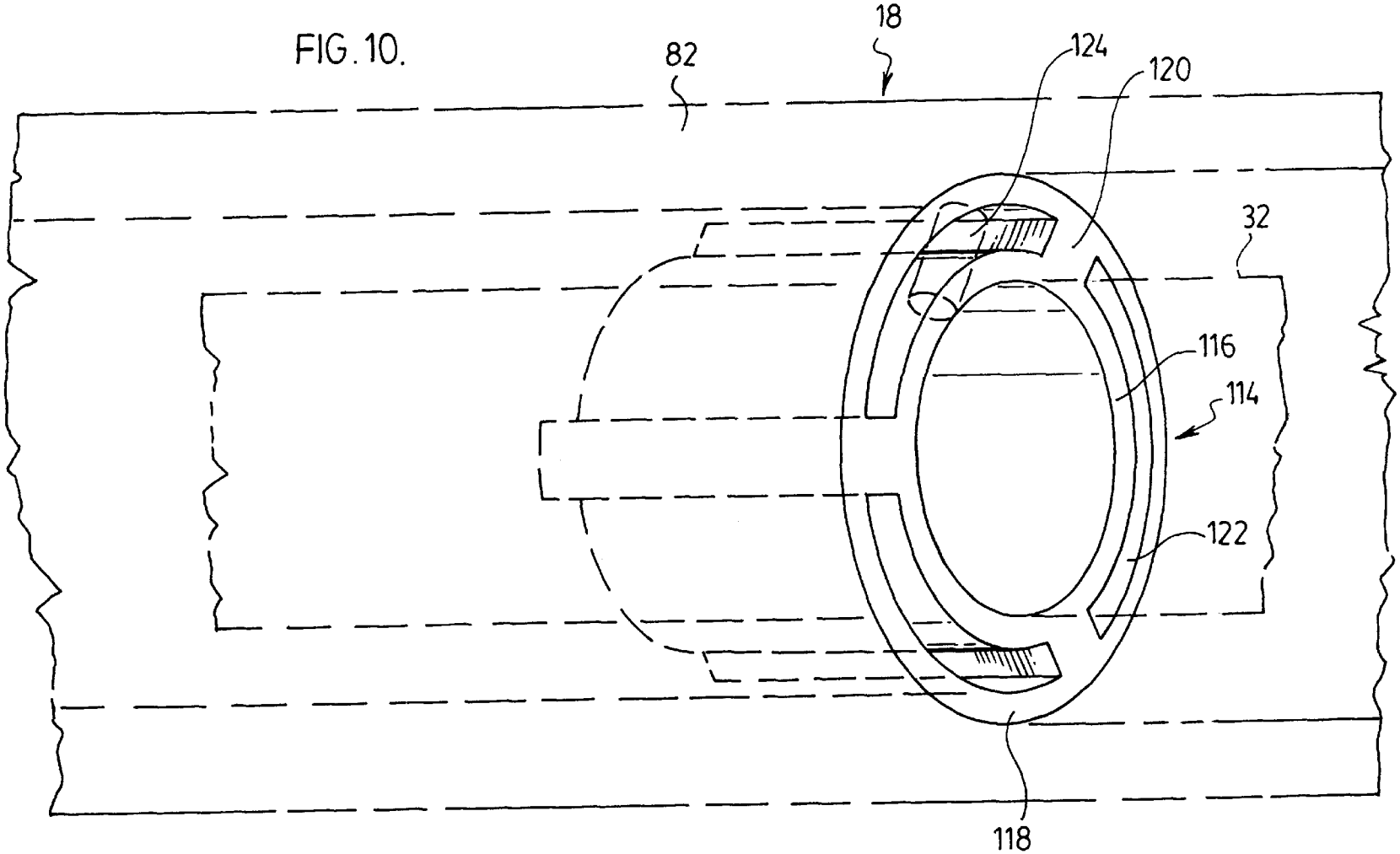
FIG. 10 shows yet another alternative embodiment for the mounting of the pressure measurement device within the drill string.

With reference to FIG. 10, an alternative embodiment for the landing sleeve is shown. In this embodiment the landing sleeve is integral with the drill string section 18 and its wall section 82. The landing sleeve 114 is machined as part of the drill string bore during the fabrication process. The landing sleeve wall 116 is spaced from the interior wall 118 of the drill string by circumferentially arranged legs 120. The landing sleeve 114 has arcuate shaped channels 122 which extend through the landing sleeve 114 and provide the necessary flow paths for the pressurized drilling fluid. The landing sleeve 114 has the port 124 extending from the exterior of the drill string section through the wall 82 through the leg 120 and through the wall 116 of the sleeve. The cylindrical tool shell 32 may be constructed in the same manner as that of FIG. 3 so that the seals 62 and 64 are positioned to each side of the port 124. This provides, as discussed with respect to the prior embodiments, for the usual communication of pressurized drilling fluid on the exterior of the drill section to within the system for measurement by the pressure transducer 52.

Accordingly, various embodiments are provided which demonstrate the effectiveness of a landing sleeve in providing for annular pressure measurements of drilling fluid, and at the same time providing for a retraction or re-seating of the cylindrical tool shell while the drill string is down hole.

Although preferred embodiments of the invention have been described herein in detail, it will be understood by those skilled in the art that variations may be made thereto without departing from the spirit of the invention or the scope of the appended claims.

What is claimed is:

1. A drill string section for use in making up a drill string for oil and gas drilling, said drill string section carrying instrumentation for Measurement While Drilling and Logging While Drilling operations, said instrumentation including a Dynamic Pressure Device for measuring drill string bore pressure of incoming pressurized fluid and drill string annular pressure of returned pressurized fluid, said instrumentation being retrievable from said drill string when said drill string section is stuck or otherwise abandoned downhole, said drill string section comprising:

i) a length of drill string pipe having a bore defined by an inner surface of a pipe wall which has an outer surface, ii) a cylindrical landing sleeve and a support for centering said sleeve in said pipe bore, iii) communicating ports extending through said drill pipe wall from said outer pipe surface to said inner surface and through said support to an inside surface of said landing sleeve, iv) said instrumentation being provided in an elongate cylindrical tool shell, spaced apart seals which engage said inside surface of said landing sleeve and the outer surface of said tool shell, means for locating said communicating ports between said spaced-apart seals, v) said instrumentation in said tool shell having a first terminated passageway in said tool shell between said seals which communicates with a pressure sensor within said shell to sense thereby said drill string annular pressure, vi) said instrumentation having a second terminated passageway in said tool shell in communication with said drill string bore and in communication with a pressure sensor within said shell whereby said drill string bore pressure is sensed.

2. A drill string of claim 1 wherein said landing sleeve comprises a hollow cylinder with said support being support legs extending in a length direction along said cylinder, said legs being adapted for securement to said inner diameter of said drill pipe and fasteners for securing said legs to said drill pipe.

3. A drill string of claim 1 wherein said landing sleeve comprises a hollow cylinder with support legs extending in a length direction along said cylinder, said support legs and said hollow cylinder being integral with said drill pipe section.

4. A drill string of claim 1 wherein said landing sleeve comprises a hollow cylinder with support legs extending in a length direction along said hollow cylinder, said support legs and said hollow cylinder being integral, said landing sleeve being positioned in said drill string by C-clips engaging said drill string and located on each side of said cylinder.

5. A drill string of claim 1 wherein each of said seals for said cylindrical tool shell, each seal is a ring seal of compressible material which permits said cylindrical shell to slide within said landing sleeve.

6. A drill string of claim 1 wherein each of said seals is provided on said inside surface of said landing sleeve.

7. A drill string of claim 1 wherein said cylindrical shell has at its upstream end, a coupling component for connection to an instrumentation retrieval device to permit withdrawal of said instrumentation from stuck or other abandoned drill string section.

8. A drill string of claim 2 wherein two or more opposing support legs are provided on said hollow cylinder, each support leg being of a thickness to provide an annulus of sufficient cross-section to accommodate typical flow rates of drilling fluid along said drill pipe bore.

9. A drill string of claim 8 wherein each of said legs have a plurality of threaded bores which are aligned with apertures in said drill pipe wall, said fasteners extending through said apertures and being threaded into said threaded bores to secure said legs to said inner surface.

10. A drill string of claim 2, wherein said legs are releasable from said fasteners to be removable from said hollow cylinder, said communicating ports extending through one of said legs.

11. A drill string of claim 1 wherein said pressure sensors are pressure transducers secured in said cylindrical tool shell.

12. A drill string of claim 1 wherein an annular space is provided in said cylindrical tool shell, said annular space being formed between said spaced apart seals and communicating with said first terminated passageway in said cylindrical tool shell, and said annular space aligned with said communicating ports to complete communication between outside said drill string pipe to said pressure sensor regardless of radial orientation about a longitudinal axis of said cylindrical tool shell.

13. A drill string of claim 1 wherein said drill pipe includes on said inner diameter and upstream of said landing sleeve a guide for guiding insertion of said cylindrical tool shell into said landing sleeve.

* * * * *